US006346871B1

(12) United States Patent
Ogasawara et al.

(10) Patent No.: US 6,346,871 B1
(45) **Date of Patent: *Feb. 12, 2002**

(54) LAMINATE TYPE VARISTOR

(75) Inventors: Tadashi Ogasawara; Ryuichi Tanaka; Mikikazu Takehana, all of Akita (JP)

(73) Assignee: TDK Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/215,134

(22) Filed: Dec. 18, 1998

(30) Foreign Application Priority Data

Jan. 9, 1998 (JP) ..... 10-150032

(51) Int. Cl.[7] ..... H01C 7/10

(52) U.S. Cl. ..... 338/21; 338/20; 338/204; 338/314

(58) Field of Search ..... 338/20, 21, 204, 338/314, 313

(56) References Cited

U.S. PATENT DOCUMENTS

| | | | | |
|---|---|---|---|---|
| 4,729,058 A | * | 3/1988 | Gupta et al. | 361/308 |
| 5,034,709 A | | 7/1991 | Azumi et al. | |
| 5,155,464 A | * | 10/1992 | Cowman et al. | 338/21 |
| 5,245,309 A | * | 9/1993 | Kawase et al. | 338/22 R |
| 5,324,986 A | | 6/1994 | Ueno et al. | |
| 6,008,717 A | * | 12/1999 | Kawase et al. | 338/21 |
| 6,087,923 A | * | 7/2000 | Ahn et al. | 338/21 |

FOREIGN PATENT DOCUMENTS

| | | | | |
|---|---|---|---|---|
| JP | 5-6806 | | 1/1993 | |
| JP | 5-6807 | | 1/1993 | |
| JP | 5-283208 | | 10/1993 | |
| JP | 6-13206 | * | 1/1994 | 338/20 |
| JP | 7235406 | * | 9/1995 | 338/21 |
| JP | 8-55710 | | 2/1996 | |

OTHER PUBLICATIONS

U.S. application No. 09/017,229, filed Feb. 2, 1998.
U.S. application No. 09/215,134, filed Dec. 18, 1998.
Patent Abstracts of Japan, vol. 017, No. 261 (E–1369), May 21, 1993, JP 05 006806, Jan. 14, 1993.

* cited by examiner

*Primary Examiner*—Karl D. Easthom
(74) *Attorney, Agent, or Firm*—Oblon, Spivak, McClelland, Maier & Neustadt, P.C.

(57) ABSTRACT

A laminate type varistor has at least one pair of first and second inner electrodes and a varistor layer. The at least one pair of first and second electrodes and the varistor layer are laminated. A first outer electrode and a second outer electrode electrically are connected to the first inner electrode and the second inner electrode, respectively. In the laminate type varistor, the first inner electrode and the first inner electrode are separated by a predetermined distance from the outer electrode so that the first inner electrode has no electrode surface facing to an electrode surface of the second inner electrode.

9 Claims, 3 Drawing Sheets

LAMINATE TYPE VARISTOR

BACKGROUND OF THE INVENTION

1. Field of the Invention

The present invention relates to a laminate type varistor adapted for being incorporated into a small-capacitance high-frequency circuit, or the like.

2. Description of the Related Art

Conventionally, as shown in FIG. 5, a laminate type varistor is configured in the following manner. That is, at least two inner electrodes 20*a* and 20*b* making a pair to each other and a varistor layer 21 are laminated. Ceramic layers 22 and 23 are provided as outermost layers for protecting the laminate. The inner electrodes 20*a* and 20*b* are electrically connected to outer electrodes 24 and 25 respectively. The varistor layer 21 has a dielectric constant. The inner electrodes 20*a* and 20*b* are formed to have surfaces W facing each other through the varistor layer 22 (Unexamined Japanese Patent Publication (kokai) Nos. Hei. 5-6806 and Hei. 5-6807).

Similarly, conventionally, also in the case where pairs of inner electrodes 30*a*, 30*b*; 31*a*, 31*b*; . . . are provided in a laminate type varistor as shown in FIG. 6. The laminate type varistor is configured in the following manner. That is, the inner electrodes 30*a*, 30*b*; 31*a*, 31*b*; . . . are formed so that the inner electrodes have surfaces W facing each other through varistor layers 32*a*, 32*b* . . . respectively. Protection ceramic layers 33 and 34 are provided as outermost layers. The inner electrodes 30*a*, 30*b*; 31*a*, 31*b*; . . . are electrically connected to outer electrodes 35 and 36 respectively (Unexamined Japanese Patent Publication (kokai) Nos. Hei. 5-283208 and Hei. 8-55710).

In the laminate type varistor configured as described above, the capacitance increases as the facing surfaces W of the inner electrodes 20*a*, 20*b*, 30*a*, 30*b*, 31*a*, 31*b* . . . increase in terms of areas. However, if the capacitance is large, a high-frequency signal may be passed through the varistor or the waveform of the signal may be distorted in the case where the varistor is used in a high-frequency circuit. To prevent this problem, it is necessary to set the capacitance to a value of about several tens of pF. In the aforementioned configuration, however, it is difficult to set the capacitance to a value of about several tens of Pf.

SUMMARY OF THE INVENTION

It is an object of the present invention to provide a laminate type varistor in which capacitance can be set to a small value while a varistor voltage is kept in a value equivalent to that of a conventional varistor.

A laminate type varistor according to the present invention comprises at least one pair of first and second inner electrodes; a varistor layer, the at least one pair of first and second electrodes and the varistor layer being laminated; and a first outer electrode and a second outer electrode electrically connected to the first inner electrode and a second inner electrode, respectively, wherein the first inner electrode and the first inner electrode are separated by a predetermined distance from the outer electrode so that the first inner electrode has no electrode surface facing to an electrode surface of the second inner electrode.

A laminate type varistor according to the present invention comprises: a ceramic sintered body comprising at least one pair of first and second inner electrodes; a varistor layer, the at least one pair of first and second electrodes and the varistor layer being laminated; and protection ceramic layers as outermost layers of the ceramic sintered body; and a first outer electrode and a second outer electrode electrically connected to the first inner electrode and a second inner electrode, respectively; wherein a width of the ceramic sintered body is equal to or longer than the sum of the lengths of the first and second inner electrodes.

DETAILED DESCRIPTION OF THE INVENTION

Figure 1:
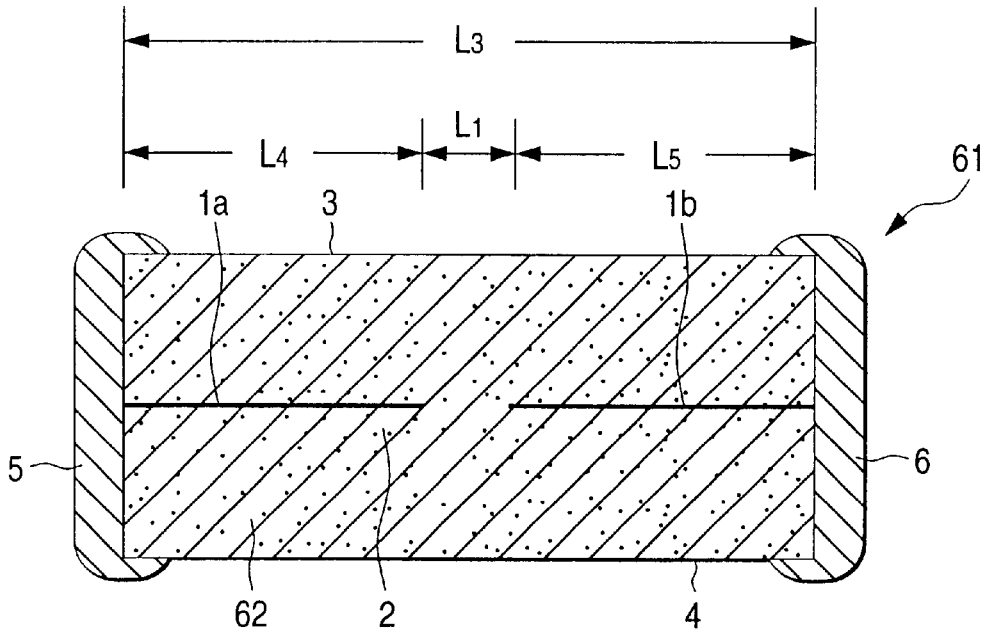
FIG. 1 is an explanatory view showing a laminate type varistor according to an embodiment of the present invention.

The present invention will be described in detail below with reference to the accompanying drawings. Each of the laminate type varistors shown in the drawings is configured in the following manner. That is, ceramic green sheets are formed from a ceramic material containing ZnO as a main component. Electric-conductive paste of Pd, Ni, Ag—Pd, or the like, is printed on each of the ceramic green sheets to form inner electrodes. The ceramic green sheets are laminated and baked to obtain a ceramic sintered body having protection ceramic layers as outermost layers. Then, Ag or Cu baked layers are plated with Ni, Sn, solder, or the like, to thereby provide outer electrodes on outer surfaces of the ceramic sintered body so that the outer electrodes are electrically connected to the inner electrodes.

A laminate type varistor 61 shown in FIG. 1 is configured in the following manner. That is, two inner electrodes, a first inner electrode 1*a* and a second inner electrode 1*b*, make a pair to each other. A varistor layer 2 are laminated and baked to thereby obtain a ceramic sintered body 62 having protection ceramic layers 3 and 4 as outermost layers. The first and second inner electrodes 1*a* and 1*b* are electrically connected to first and second outer electrodes 5 and 6, respectively.

Figure 2:
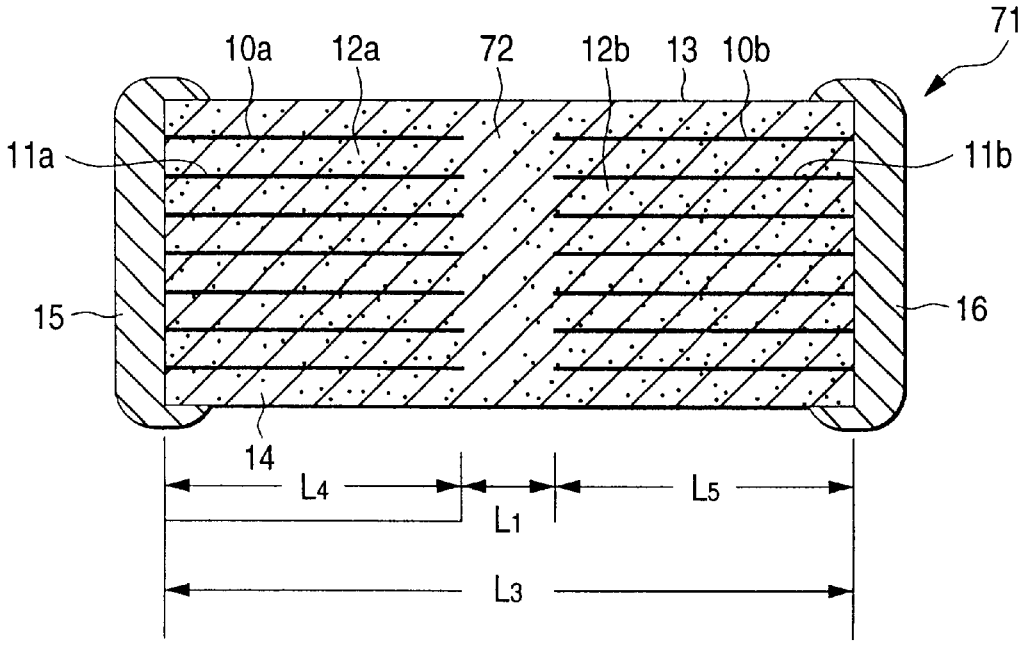
FIG. 2 is an explanatory view showing a laminate type varistor according to another embodiment of the present invention.

A laminate type varistor 71 shown in FIG. 2 has a plurality of pairs of first and second inner electrodes 10*a*, 10*b*; 11*a*, 11*b*; . . . This laminate type varistor 72 is configured in the following manner. That is, a plurality of varistor layers 12*a*, 12*b* . . . and protection ceramic layers 13 and 14 as outermost layers are laminated and baked to thereby obtain a ceramic sintered body 72. First and second outer electrodes 15 and 16 are provided so as to be electrically connected to the pairs of the first and second inner electrodes 10*a*, 10*b*; 11*a*, 11*b*; . . . In the case where about six layers are to be laminated as the varistor layers in the multilayer-structure laminate type varistor 71, each layer may be formed to have a thickness of about 60 $\mu$m.

Figure 4:
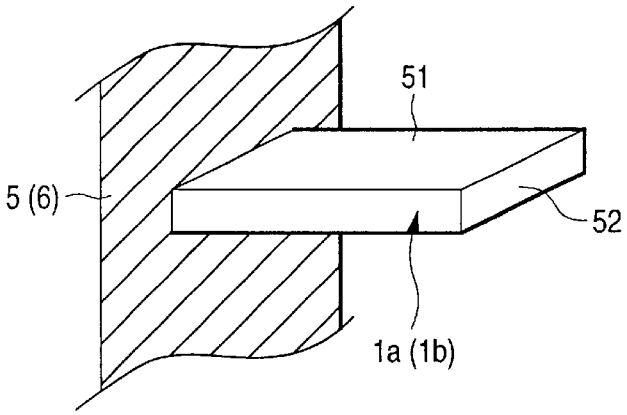
FIG. 4 is a perspective view showing the structure of an inner electrode.
Figure 5:
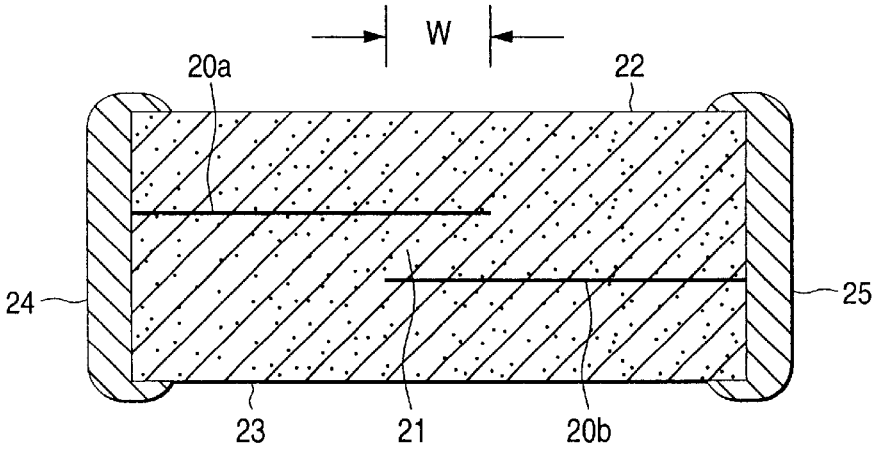
FIG. 5 PRIOR ART
FIG. 5 is an explanatory view showing a laminate type varistor as a conventional example.
Figure 6:
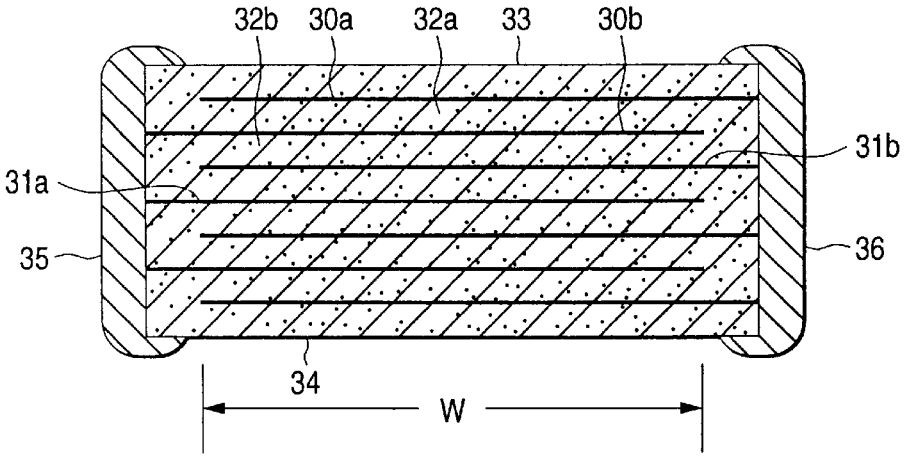
FIG. 6 PRIOR ART
FIG. 6 is an explanatory view showing a laminate type varistor as another conventional example.

In the laminate type varistors 61, 71 shown in FIGS. 1 and 2, the first and second inner electrodes 1*a*, 1*b*; 10*a*, 10*b*; 11*a*, 11*b*; . . . each making a pair to each other are separated by a predetermined distance $L_1$ from each other so that the respective pairs of the first and second inner electrodes 1*a*, 1*b*; 10*a*, 10*b*; 11*a*, 11*b*; . . . are formed respectively on the same planes which are the varistor layers 2; 12*a*; 12*b*; . . . so that the pairs of the first and second inner electrodes have no surfaces facing each other, i.e. no other electrode extends beyond the first inner electrode or the second inner electrode in the widthwise direction. For example, as shown in FIG. 4, the inner electrode 1*a*(1*b*) has an electrode surface 51 and a tip end surface 52. In this case, the electrode surface 51 of the first inner electrode 1*a* does not face to that of the second inner electrode 1*b*. In the laminate type varistors 61, 71, the varistor voltage and capacitance are affected by the distance $L_1$ by which the pairs of the first and second inner electrodes 1*a*, 1*b*; 10*a*, 10*b*; 11*a*, 11*b*; . . . are separated from each other. For example, when the varistor voltage is 12 V, the separation distance $L_1$ may be set to about 66 $\mu$m. For example, when the varistor voltage is 27 V, the separation distance $L_1$ may be set to about 120 $\mu$m.

As shown in FIG. 1, a width $L_3$ of the ceramic sintered body 62 is longer than the sum of a length $L_4$ of the first inner electrode 1*a* and a length $L_5$ of the second inner electrode. Preferably, the width $L_3$ is from more than 0 to not more than 800 $\mu$m. In the present invention, the distance $L_1$ is preferably not more than half of the width $L_3$. These relationships among the lengths, width and distance is also applied to the ceramic sintered body 72 as shown in FIG. 2.

There is another case besides the case where the pairs of first and second inner electrodes 1*a*, 1*b*; 10*a*, 10*b*; 11*a*, 11*b*; . . . are formed respectively on the same planes which are the varistor layers 2, 12*a*, 12*b* . . . For example, the inner electrodes 1*a* and 1*b* making a pair to each other may be separated from each other by a predetermined separation distance $L_2$ in the thickness direction as seen in the laminate type varistor 81 shown in FIG. 3A so that the first and second inner electrodes 1*a* and 1*b* are disposed in different planes separated by the varistor layer 2, but they are formed as inner electrodes having no surfaces facing each other. In this case, the separation distance $L_2$ by which the first and second inner electrodes 1*a* and 1*b* are separated from each other, can be secured by the distance between the inner ends where the first and second inner electrodes 1*a* and 1*b* do not face each other and the thickness of the varistor layer 2 interposed between the first and second inner electrodes 1*a* and 1*b*.

Figure 3A:
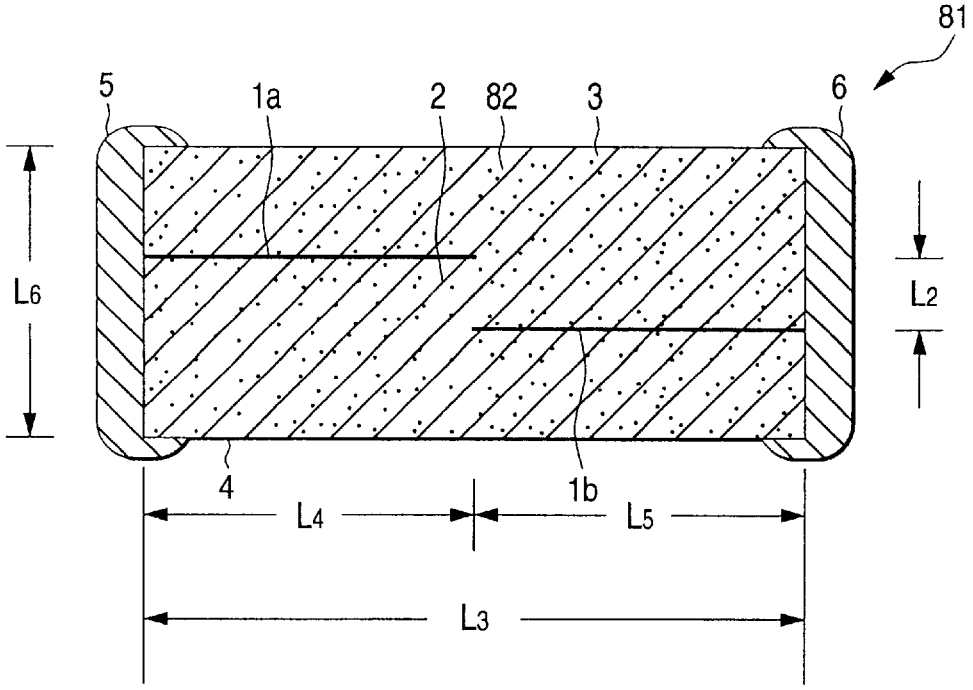
FIG. 3A is an explanatory view showing a laminate type varistor according to a further embodiment of the present invention.
Figure 3B:
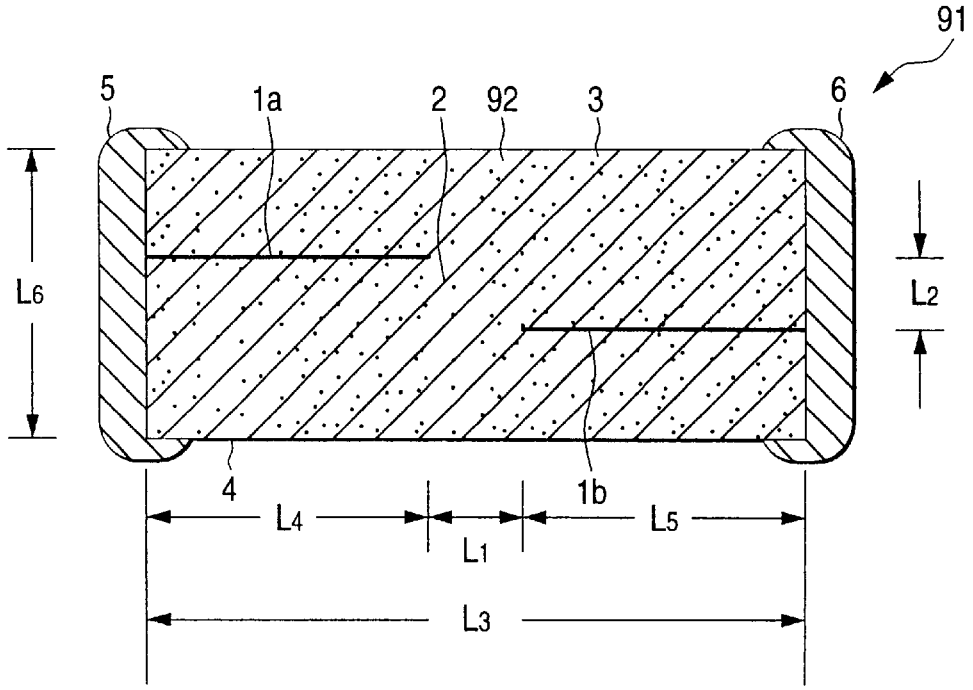
FIG. 3B is an explanatory view showing a laminate type varistor of a modified embodiment of the embodiment shown in FIG. 3A.

Further, in addition to the embodiment shown in FIG. 3A, it is possible to form the distance $L_1$ between the first and second inner electrodes 1*a* and 1*b*, in the varistor as shown in FIG. 3B. The lengths, thickness and distance relationships of FIGS. 1 and 3A can also be applied to a ceramic sintered body 92 of a varistor 91 as shown in FIG. 3B.

In case of FIGS. 3A and 3B, a thickness $L_6$ of the ceramic sintered body is preferably from not less than 0 to not more than 800 $\mu$m. The distance $L_2$ is less than the thickness $L_6$. Further, in this case, the width $L_3$ is equal to or longer than the sum of the length $L_4$ of the first inner electrode 1*a* and the length $L_5$ of the second inner electrode 1*b*.

In comparison with the characteristic of conventional laminate type varistors having 1 varistor layer and 6 varistor layers, and the present invention's laminate type varistors having 1 varistor layer, 6 varistor layers and 27 varistor layers respectively were produced on the basis of the configurations of the laminate type varistors shown in FIGS. 1 and 2. The results of comparison about the characteristic are shown in the following Table 1. The capacitance (pF) was reduced extremely in comparison with that of the conventional laminate type varistor. Also the withstand electrostatic voltage resistance measured in terms of the rate of the change of the varistor voltage after 100 times repetition of a pulse of 30 KV was substantially equivalent to or better than that of the conventional laminate type varistor.

TABLE 1

| | Conventional | | | | Present invention | | | | | |
|---|---|---|---|---|---|---|---|---|---|---|
| | 1 layer | | 6 layers | | 1 layer | | 6 layers | | 27 layers | |
| Sintering Temperature (° C.) | 1165 | 1134 | 1200 | 1150 | 1320 | 1225 | 1280 | 1210 | 1250 | 1170 |
| Varistor Voltage (V) | 12 | 27 | 12 | 27 | 12 | 27 | 12 | 27 | 12 | 27 |
| Capacitance (pF) | 205 | 110 | 1050 | 420 | 70 | 20 | 90 | 40 | 95 | 50 |
| Electrostatic Voltage Resistance (%) | −6 | −4 | 0 | 0 | −9 | −7 | −5 | −3 | 0 | 0 |

Further, as seen from the above Table 1, the varistor voltage is determined by the separation distance by which the inner electrodes are separated from each other. Accordingly, a laminate type varistor having a target characteristic can be obtained easily if the separation distance and the total number of varistor layers are adjusted in accordance with the required value of capacitance. Incidentally, the baking temperature in the present invention is set to be more or less higher than that in the conventional case. This is because the number of varistor layers is increased in number by space for separating the inner electrodes from each other are interposed.

As described above, in the laminate type varistor according to the present invention, inner electrodes making a pair to each other are separated from each other so that the inner electrodes are formed to have no electrode surfaces facing each other. Accordingly, the capacitance can be set to a small value while the varistor voltage is kept in a value equivalent to that of the conventional laminate type varistor. Even in the case where the varistor according to the present invention is used in a high-frequency circuit, the high-frequency signal can be prevented from passing through the varistor or the waveform of the signal can be prevented from being distorted. Further, because the varistor voltage can be determined by the separation distance by which the inner electrodes are separated from each other, a laminate type varistor having a target characteristic can be obtained easily if the separation distance and the total number of varistor layers are adjusted in accordance with the required value of capacitance.

What is claimed is:

1. A laminate type varistor, comprising:

at least one pair of electrodes including a first inner electrode and a second inner electrode extending in a widthwise direction;

a varistor layer, said at least one pair of electrodes and said varistor layer being laminated; and a first outer electrode and a second outer electrode electrically connected to said first inner electrode and said second inner electrode, respectively;

wherein said first inner electrode and said second inner electrode are separated by a predetermined distance from each other so that said first inner electrode has no electrode surface facing to an electrode surface of said second inner electrode and no other electrode extends beyond the first inner electrode or the second inner electrode in the widthwise direction;

wherein a capacitance between said first and second outer electrodes is less than 100 pF, and wherein said first and second inner electrodes of said at least one pair of electrodes are formed on different planes from each other separated through said varistor layer.

2. The laminate type varistor according to claim 1, wherein said at least one pair of electrodes includes a plurality of pairs of first and second inner electrodes.

3. A laminate type varistor comprising:

a ceramic sintered body comprising at least one pair of electrodes including a first inner electrode and a second inner electrode having lengths extending in a widthwise direction of said ceramic sintered body; a varistor layer, said at least one pair of electrodes and said varistor layer being laminated; and protection ceramic layers as outermost layers of said ceramic sintered body; and a first outer electrode and a second outer electrode electrically connected to said first inner electrode and said second inner electrode, respectively;

wherein a width of said ceramic sintered body is equal to or longer than the sum of the lengths of said first and second inner electrodes and no other electrode extends beyond the first inner electrode or the second inner electrode in the widthwise direction;

wherein a capacitance between said first and second outer electrodes is less than 100 pF, and wherein said first and second inner electrodes of said at least one pair of electrodes are formed on different planes from each other separated through said varistor layer.

4. The laminate type varistor according to claim 3, wherein the width of said ceramic sintered body is longer than the sum of the lengths of said first and second inner electrodes.

5. The laminate type varistor according to claims 3, wherein a distance between said first and second inner electrodes is not more than half of the width of said ceramic sintered body.

6. The laminate type varistor according to claim 3, wherein a thickness of said ceramic sintered body is longer than a distance in a thickness direction between said first and second electrodes.

7. The laminate type varistor according to claim 6, wherein a thickness of said ceramic sintered body is longer than a distance in a thickness direction between said first and second electrodes.

8. A laminate type varistor, comprising:

at least one pair of electrodes including a first inner electrode and a second inner electrode extending in a widthwise direction;

a varistor layer, said at least one pair of electrodes and said varistor layer being laminated; and a first outer electrode and a second outer electrode electrically connected to said first inner electrode and said second inner electrode, respectively;

wherein said first inner electrode and said second inner electrode are separated by a predetermined distance from each other so that said first inner electrode has no electrode surface facing to an electrode surface of said second inner electrode and no other electrode extends beyond the first inner electrode or the second inner electrode in the widthwise direction; and wherein said first and second inner electrodes of said at least one pair of electrodes are formed on different planes from each other separated through said varistor layer and no two inner electrodes are formed on a same plane.

9. A laminate type varistor comprising:

a ceramic sintered body comprising at least one pair of electrodes including a first inner electrode and a second inner electrode having lengths extending in a widthwise direction of said ceramic sintered body; a varistor layer, said at least one pair of electrodes and said varistor layer being laminated; and protection ceramic layers as outermost layers of said ceramic sintered body; and a first outer electrode and a second outer electrode electrically connected to said first inner electrode and said second inner electrode, respectively;

wherein a width of said ceramic sintered body is equal to or longer than the sum of the lengths of said first and second inner electrodes and no other electrode extends beyond the first inner electrode or the second inner electrode in the widthwise direction; and wherein said first and second inner electrodes of said at least one pair of electrodes are formed on different planes from each other separated through said varistor layer and no two inner electrodes red on a same plane.

* * * * *

UNITED STATES PATENT AND TRADEMARK OFFICE

CERTIFICATE OF CORRECTION

PATENT NO. : 6,346,871 B1
DATED : February 12, 2002
INVENTOR(S) : Ogasawara et al.

It is certified that error appears in the above-identified patent and that said Letters Patent is hereby corrected as shown below:

Title page,
Item [30], the Foreign Application Priority information should read:

-- [30] Foreign Application Priority Data
Jan. 9, 1998 (JP) …….. 10-015032 --

Signed and Sealed this

Seventeenth Day of September, 2002

*Attest:*

*Attesting Officer*

JAMES E. ROGAN
*Director of the United States Patent and Trademark Office*